US009230537B2

(12) United States Patent
Saino

(10) Patent No.: US 9,230,537 B2
(45) Date of Patent: Jan. 5, 2016

(54) VOICE SYNTHESIS APPARATUS USING A PLURALITY OF PHONETIC PIECE DATA

(75) Inventor: Keijiro Saino, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 750 days.

(21) Appl. No.: 13/485,303

(22) Filed: May 31, 2012

(65) Prior Publication Data

US 2012/0310651 A1 Dec. 6, 2012

(30) Foreign Application Priority Data

Jun. 1, 2011 (JP) ..... 2011-123770
May 14, 2012 (JP) ..... 2012-110358

(51) Int. Cl.
*G10L 13/07* (2013.01)
*G10L 13/033* (2013.01)
*G10L 21/049* (2013.01)
*G10L 25/93* (2013.01)

(52) U.S. Cl.
CPC ..... *G10L 13/07* (2013.01); *G10L 13/033* (2013.01); *G10L 21/049* (2013.01); *G10L 25/93* (2013.01)

(58) Field of Classification Search
USPC ..... 704/200–201, 258–269, 270, 278, 704/500–501, E19.001–E19.049, 704/E13.001–E13.014
See application file for complete search history.

(56) References Cited

U.S. PATENT DOCUMENTS 4,128,737 A * 12/1978 Dorais ..... 704/265
4,214,125 A * 7/1980 Mozer et al. ..... 704/268
4,470,150 A * 9/1984 Ostrowski ..... 704/261
4,586,193 A * 4/1986 Seiler et al. ..... 704/261
4,852,170 A * 7/1989 Bordeaux ..... 704/277
5,163,110 A * 11/1992 Arthur et al. ..... 704/200
5,384,893 A * 1/1995 Hutchins ..... 704/267
5,463,715 A * 10/1995 Gagnon ..... 704/267
5,611,019 A * 3/1997 Nakatoh et al. ..... 704/233
5,703,311 A * 12/1997 Ohta ..... 84/622

(Continued)

FOREIGN PATENT DOCUMENTS

EP 1 220 194 A2 7/2002
EP 1 239 457 A2 9/2002

(Continued)

OTHER PUBLICATIONS

Partial European Search Report dated Aug. 9, 2013 (four (4) pages).

(Continued)

*Primary Examiner* — Pierre-Louis Desir
*Assistant Examiner* — David Kovacek
(74) *Attorney, Agent, or Firm* — Crowell & Moring LLP

(57) ABSTRACT

A voice signal is synthesized using a plurality of phonetic piece data each indicating a phonetic piece containing at least two phoneme sections corresponding to different phonemes. In the apparatus, a phonetic piece adjustor forms a target section from first and second phonetic pieces so as to connect the first and second phonetic pieces to each other such that the target section includes a rear phoneme section of the first piece and a front phoneme section of the second piece, and expands the target section by a target time length to form an adjustment section such that a central part is expanded at an expansion rate higher than that of front and rear parts of the target section, to thereby create synthesized phonetic piece data having the target time length. A voice synthesizer creates a voice signal from the synthesized phonetic piece data.

6 Claims, 9 Drawing Sheets

(56) References Cited

U.S. PATENT DOCUMENTS

| | | | | |
|---|---|---|---|---|
| 6,081,780 | A * | 6/2000 | Lumelsky | 704/260 |
| 6,088,674 | A * | 7/2000 | Yamazaki | 704/266 |
| 6,240,384 | B1 * | 5/2001 | Kagoshima et al. | 704/220 |
| 6,304,846 | B1 * | 10/2001 | George et al. | 704/270 |
| 6,308,156 | B1 | 10/2001 | Barry et al. | |
| 6,470,316 | B1 * | 10/2002 | Chihara | 704/267 |
| 7,047,194 | B1 * | 5/2006 | Buskies | 704/258 |
| 7,130,799 | B1 * | 10/2006 | Amano et al. | 704/262 |
| 2002/0184006 | A1 | 12/2002 | Yoshioka et al. | |
| 2003/0004723 | A1 * | 1/2003 | Chihara | 704/260 |
| 2004/0098256 | A1 * | 5/2004 | Nissen | 704/220 |
| 2008/0319755 | A1 * | 12/2008 | Nishiike et al. | 704/267 |
| 2011/0054910 | A1 * | 3/2011 | Fujihara et al. | 704/278 |
| 2012/0150544 | A1 * | 6/2012 | McLoughlin et al. | 704/262 |
| 2012/0215528 | A1 * | 8/2012 | Nagatomo | 704/211 |

FOREIGN PATENT DOCUMENTS

| | | | |
|---|---|---|---|
| GB | 2 284 328 | A | 5/1995 |
| JP | 7-129193 | A | 5/1995 |
| JP | 3711880 | B2 | 11/2005 |
| JP | 2007-226174 | A | 9/2007 |
| WO | WO 2004/027758 | A1 | 4/2004 |
| WO | WO 2004/077381 | A1 | 9/2004 |

OTHER PUBLICATIONS

European Search Report dated Nov. 21, 2013 (twelve (12) pages).

* cited by examiner

| PHONEME CLASSIFICATION | | | |
|---|---|---|---|
| VOWEL : /a/,/i/,/u/, ..... | | | |
| PLOSIVE SOUND : /t/,/k/,/p/;..... | C1a | C1 | CONSONANT |
| AFFRICATE : /ts/, ..... | | | |
| ⋮ | | | |
| NASAL SOUND : /m/,/n/, ..... | | | |
| LIQUID SOUND : /r/, ..... | C1b | | |
| ⋮ | | | |
| FRICATIVE SOUND : /s/,/f/, ..... | | C2 | |
| SEMIVOWEL : /w/,/y/, ..... | | | |
| ⋮ | | | |

VOICE SYNTHESIS APPARATUS USING A PLURALITY OF PHONETIC PIECE DATA

BACKGROUND OF THE INVENTION

1. Technical Field of the Invention

The present invention relates to a technology for interconnecting a plurality of phonetic pieces to synthesize a voice, such as a speech voice or a singing voice.

2. Description of the Related Art

In a voice synthesis technology of phonetic piece connection type for interconnecting a plurality of phonetic pieces to synthesize a desired voice, it is necessary to expand and contract a phonetic piece to a target time length. Japanese Patent Application Publication No. H7-129193 discloses a construction in which a plurality of kinds of phonetic pieces is classified into a stable part and a transition part, and the time length of each phonetic piece is separately adjusted in the normal part and the transition part. For example, the normal part is more greatly expanded and contracted than the transition part.

In a technology of Japanese Patent Application Publication No. H7-129193, the time length is adjusted at a fixed expansion and contraction rate within a range of a phonetic piece classified into the normal part or the transition part. In real pronunciation, however, a degree of expansion may be changed on a section to section basis even within a range of a phonetic piece (phoneme). In the technology of Japanese Patent Application Publication No. H7-129193, therefore, an aurally unnatural voice (that is, a voice different from a really pronounced sound) may be synthesized in a case in which a phonetic piece is expanded.

SUMMARY OF THE INVENTION

The present invention has been made in view of the above problems, and it is an object of the present invention to synthesize an aurally natural voice even in a case in which a phonetic piece is expanded.

Means adopted by the present invention so as to solve the above problems will be described. Meanwhile, in the following description, elements of embodiments, which will be described below, corresponding to those of the present invention are shown in parentheses for easy understanding of the present invention; however, the scope of the present invention is not limited to illustration of the embodiments.

A voice synthesis apparatus according to a first aspect of the present invention is designed for synthesizing a voice signal using a plurality of phonetic piece data each indicating a phonetic piece which contains at least two phoneme sections (for example, a phoneme section $S_1$ and a phoneme section $S_2$) corresponding to different phonemes. The apparatus comprises; a phonetic piece adjustment part (for example, a phonetic piece adjustment part 26) that forms a target section (for example, a target section $W_A$) from a first phonetic piece (for example, a phonetic piece $V_1$) and a second phonetic piece (for example, a phonetic piece $V_2$) so as to connect the first phonetic piece and the second phonetic piece to each other such that the target section is formed of a rear phoneme section of the first phonetic piece corresponding to a consonant phoneme and a front phoneme section of the second phonetic piece corresponding to the consonant phoneme, and that carries out an expansion process for expanding the target section by a target time length to form an adjustment section (for example, an adjustment section $W_B$) such that a central part of the target section is expanded at an expansion rate higher than that of a front part and a rear part of the target section, to thereby create synthesized phonetic piece data (for example, synthesized phonetic piece data $D_B$) of the adjustment section having the target time length and corresponding to the consonant phoneme; and a voice synthesis part (for example, a voice synthesis part 28) that creates a voice signal from the synthesized phonetic piece data created by the phonetic piece adjustment part.

In the above construction, the expansion rate is changed in the target section corresponding to a phoneme of a consonant, and therefore, it is possible to synthesize an aurally natural voice as compared with the construction of Japanese Patent Application Publication No. H7-129193 in which an expansion and contraction rate is fixedly maintained within a range of a phonetic piece.

In a preferred aspect of the present invention, each phonetic piece data comprises a plurality of unit data corresponding to a plurality of frames arranged on a time axis. In case that the target section corresponds to a voiced consonant phoneme, the phonetic piece adjustment part expands the target section to the adjustment section such that the adjustment section contains a time series of unit data corresponding to the front part (for example, a front part $\sigma$1) of the target section, a time series of a plurality of repeated unit data which are obtained by repeating unit data corresponding to a central point (for example, a time point tAc) of the target section, and a time series of a plurality of unit data corresponding to the rear part (for example, a rear part $\sigma$2) of the target section.

In the above aspect, a time series of plurality of unit data corresponding to the front part of the target section and a time series of a plurality of unit data corresponding to the rear part of the target section are applied as unit data of each frame of the adjustment section, and therefore, the expansion process is simplified as compared with, for example, a construction in which both the front part and the rear part are expanded. The expansion of the target section according to the above aspect is particularly preferable in a case in which the target section corresponds to a phoneme of a voiced consonant.

In a preferred aspect of the present invention, the unit data of the frame of the voiced consonant phoneme comprises envelope data designating characteristics of a shape in an envelope line of a spectrum of a voice and spectrum data indicating the spectrum of the voice. The phonetic piece adjustment part generates the unit data corresponding to the central point of the target section such that the generated unit data comprises envelope data obtained by interpolating the envelope data of the unit data before and after the central point of the target section and spectrum data of the unit data immediately before or after the central point.

In the above aspect, the envelope data created by interpolating the envelope data of the unit data before and after the central point of the target section are included in the unit data after expansion, and therefore, it is possible to synthesize a natural voice in which a voice component of the central point of the target section is properly expanded.

In a preferred aspect of the present invention, the phonetic piece data comprises a plurality of unit data corresponding to a plurality of frames arranged on a time axis. In case that the target section corresponds to an unvoiced consonant phoneme, the phonetic piece adjustment part sequentially selects the unit data of each frame of the target section as unit data of each frame of the adjustment section to create the synthesized phonetic piece data, wherein velocity (for example, progress velocity $\nu$), at which each frame in the target section corresponding to each frame in the adjustment section is changed according to passage of time in the adjustment section, is decreased from a front part to a central point (for example, a central point tBc) of the adjustment section and increased from the central point to a rear part of the adjustment section.

The expansion of the target section according to the above aspect is particularly preferable in a case in which the target section corresponds to a phoneme of an unvoiced consonant.

In a preferred aspect of the present invention, the unit data of the frame of an unvoiced sound comprises spectrum data indicating a spectrum of the unvoiced sound. The phonetic piece adjustment part creates the unit data of the frame of the adjustment section such that the created unit data comprises spectrum data of a spectrum containing a predetermined noise component (for example, a noise component p) adjusted according to an envelope line (for example, an envelope line $E_{NV}$) of a spectrum indicated by spectrum data of unit data of a frame in the target section.

For example, preferably the phonetic piece adjustment part sequentially selects the unit data of each frame of the target section and creates the synthesized phonetic piece data such that the unit data thereof comprises spectrum data of a spectrum containing a predetermined noise component adjusted based on an envelope line of a spectrum indicated by spectrum data of the selected unit data of each frame in the target section (second embodiment).

Alternately, the phonetic piece adjustment part selects the unit data of a specific frame of the target section (for example, one frame corresponding to a central point of the target section) and creates the synthesized phonetic piece data such that the unit data thereof comprises spectrum data of a spectrum containing a predetermined noise component adjusted based on an envelope line of a spectrum indicated by spectrum data of the selected unit data of the specific frame in the target section (third embodiment).

In the above aspect, unit data of a spectrum in which a noise component (typically, a white noise) is adjusted based on the envelope line of the spectrum indicated by the unit data of the target section are created, and therefore, it is possible to synthesize a natural voice, acoustic characteristics of which is changed for every frame, even in a case in which a frame in the target section is repeated over a plurality of frames in the adjustment section.

By the way, manner of expansion of really pronounced phonemes are different depending upon type of phonemes. In the technology of Japanese Patent Application Publication No. H7-129193, however, expansion rates are merely different between the normal part and the transition part with the result that it may not be possible to synthesize a natural voice according to type of phonemes. In view of the above problems, a voice synthesis apparatus according to a second aspect of the present invention is designed for synthesizing a voice signal using a plurality of phonetic piece data each indicating a phonetic piece which contains at least two phoneme sections corresponding to different phonemes, the apparatus comprising a phonetic piece adjustment part that uses different expansion processes based on types of phonemes indicated by the phonetic piece data. In the above aspect, an appropriate expansion process is selected according to type of a phoneme to be expanded, and therefore, it is possible to synthesize a natural voice as compared with the technology of Japanese Patent Application Publication No. H7-129193.

For example, in a preferred example in which the first aspect and the second aspect are combined, a phoneme section (for example, a phoneme section $S_2$) corresponding to a phoneme of a consonant of a first type (for example, a type C1*a* or a type C1*b*) which is positioned at the rear of a phonetic piece and pronounced through temporary deformation of a vocal tract includes a preparation process (for example, a preparation process pA1 or a preparation process pB1) just before deformation of the vocal tract, a phoneme section (for example, a phoneme section $S_1$) which is positioned at the front of a phonetic piece and corresponds to the phoneme of the consonant of the first type includes a pronunciation process (for example, a pronunciation process pA2 or a pronunciation process pB2) in which the phoneme is pronounced as the result of temporary deformation of the vocal tract, a phoneme section corresponding to a phoneme of a consonant of a second type (for example, a second type C2) which is positioned at the rear of a phonetic piece and can be normally continued includes a process (for example, a front part pC1) in which pronunciation of the phoneme is commenced, a phoneme section which is position at the front of a phonetic piece and corresponds to the phoneme of the consonant of the second type includes a process (for example, a rear part pC2) in which pronunciation of the phoneme is ended.

Under the above circumstance, the phonetic piece adjustment part carries out the already described expansion process for expanding the target section by a target time length to form an adjustment section such that a central part of the target section is expanded at an expansion rate higher than that of a front part and a rear part of the target section in case that the consonant phoneme of the target section belongs to one type (namely the second type C2) including fricative sound and semivowel sound, and carries out another expansion process in case that the consonant phoneme of the target section belongs to another type (namely the first type C1) including plosive sound, affricate sound, nasal sound and liquid sound for inserting an intermediate section between the rear phoneme section of the first phonetic piece and the front phoneme section of the second phonetic piece in the target section.

In the above aspect, the same effects as the first aspect are achieved, and, in addition, it is possible to properly expand a phoneme of the first type pronounced through temporary deformation of the vocal tract.

For example, in a case in which the phoneme of the consonant corresponding to the target section is a phoneme (for example, a plosive sound or an affricate) of the first type in which an air current is stopped at the preparation process (for example, the preparation process pA1), the phonetic piece adjustment part inserts a silence section as the intermediate section.

Also, in a case in which the phoneme of the consonant corresponding to the target section is a phoneme (for example, a liquid sound or a nasal sound) of the first type in which pronunciation is maintained through ventilation at the preparation process (for example, the preparation process pB1), the phonetic piece adjustment part inserts an intermediate section containing repetition of a frame selected from the rear phoneme section of the first phonetic piece or the front phoneme section of the second phonetic piece in case that the consonant phoneme of the target section is nasal sound or liquid sound. For example, the phonetic piece adjustment part inserts the intermediate section containing repetition of the last frame of the rear phoneme section of the first phonetic piece. Alternatively, the phonetic piece adjustment part inserts the intermediate section containing repetition of the top frame of the front phoneme section of the second phonetic piece.

The voice synthesis apparatus according to each aspect described above is realized by hardware (an electronic circuit), such as a digital signal processor (DSP) which is exclusively used to synthesize a voice, and, in addition, is realized by a combination of a general processing unit, such as a central processing unit (CPU), and a program. A program (for example, a program $P_{GM}$) of the present invention is executed by a computer to perform a method of synthesizing a voice signal using a plurality of phonetic piece data each indicating a phonetic piece which contains at least two phoneme sections corresponding to different phonemes, the method comprising: forming a target section from a first phonetic piece and a second phonetic piece so as to connect the first phonetic piece and the second phonetic piece to each other such that the target section is formed of a rear phoneme section of the first phonetic piece corresponding to a consonant phoneme and a front phoneme section of the second phonetic piece corresponding to the consonant phoneme; carrying out an expansion process for expanding the target section by a target time length to form an adjustment section such that a central part of the target section is expanded at an expansion rate higher than that of a front part and a rear part of the target section, to thereby create synthesized phonetic piece data of the adjustment section having the target time length and corresponding to the consonant phoneme; and creating a voice signal from the synthesized phonetic piece data.

The program as described above realizes the same operation and effects as the voice synthesis apparatus according to the present invention. The program according to the present invention is provided to users in a form in which the program is stored in machine readable recording media that can be read by a computer so that the program can be installed in the computer, and, in addition, is provided from a server in a form in which the program is distributed via a communication network so that the program can be installed in the computer.

DETAILED DESCRIPTION OF THE INVENTION

A: First Embodiment

Figure 1:
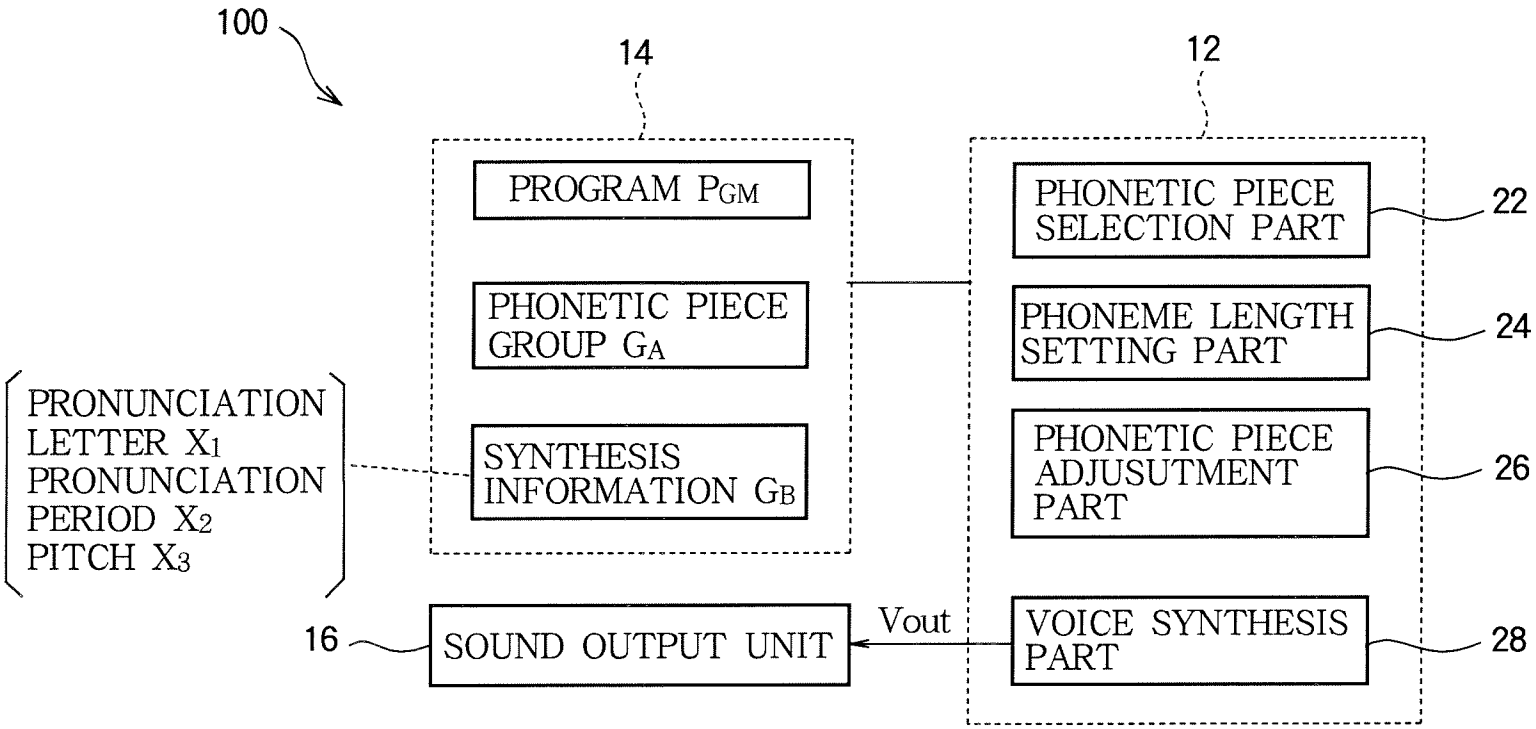
FIG. 1 is a block diagram of a voice synthesis apparatus according to a first embodiment of the present invention.

FIG. 1 is a block diagram of a voice synthesis apparatus 100 according to a first embodiment of the present invention. The voice synthesis apparatus 100 is a signal processing apparatus that creates a voice, such as a speech voice or a singing voice, through a voice synthesis processing of the phonetic piece connection type. As shown in FIG. 1, the voice synthesis apparatus 100 is realized by a computer system including a central processing unit 12, a storage unit 14, and a sound output unit 16.

The central processing unit (CPU) 12 executes a program $P_{GM}$ stored in the storage unit 14 to perform a plurality of functions (a phonetic piece selection part 22, a phoneme length setting part 24, a phonetic piece adjustment part 26, and a voice synthesis part 28) for creating a voice signal $V_{OUT}$ indicating the waveform of a synthesized sound. Meanwhile, the respective functions of the central processing unit 12 may be separately realized by a plurality of integrated circuits, or a designated electronic circuit, such as a DSP, may realize some of the functions. The sound output unit 16 (for example, a headphone or a speaker) outputs a sound wave corresponding to the voice signal $V_{OUT}$ created by the central processing unit 12.

The storage unit 14 stores the program $P_{GM}$, which is executed by the central processing unit 12, and various kinds of data (phonetic piece group $G_A$ and synthesis information $G_B$), which are used by the central processing unit 12. Well-known recording media, such as semiconductor recording media or magnetic recording media, or a combination of a plurality of kinds of recording media may be adopted as the storage unit 14.

Figures 2, 3:
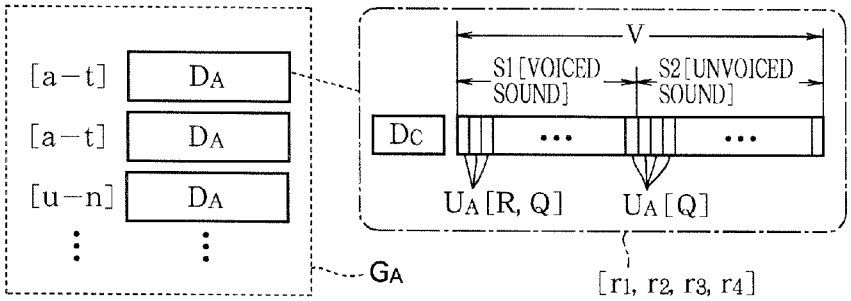
FIG. 2 is a typical view of a phonetic piece group stored in a storage unit.
FIG. 3 is a diagram showing classification of phonemes.

As shown in FIG. 2, the phonetic piece group $G_A$ stored in the storage unit 14 is a set (voice synthesis library) of a plurality of phonetic piece data $D_A$ corresponding to different phonetic pieces V. As shown in FIG. 2, a phonetic piece V in the first embodiment is a diphone (phoneme chain) interconnecting two phoneme sections S ($S_1$ and $S_2$) corresponding to different phonemes. The phoneme section $S_1$ is a section including a start point of the phonetic piece V. The phoneme section $S_2$ is a section including an end point of the phonetic piece V. The phoneme section $S_2$ follows the phoneme section $S_1$. In the following, silence will be described as a kind of phoneme for the sake of convenience.

As shown in FIG. 2, each piece of phonetic piece data $D_A$ includes classification information $D_C$ and a time series of a plurality of unit data $U_A$. The classification information $D_C$ designates type of phonemes (hereinafter, referred to as 'phoneme type') respectively corresponding to the phoneme section $S_1$ and the phoneme section $S_2$ of the phonetic piece V. For example, as shown in FIG. 3, phoneme type, such as vowels /a/, /i/ and /u/, plosive sounds /t/, /k/ and /p/, an affricate /ts/, nasal sounds /m/ and /n/, a liquid sound /r/, fricative sounds /s/ and /f/, and semivowels /w/ and /y/, is designated by the classification information $D_C$. Each piece of a plurality of unit data UA included in phonetic piece data $D_A$ of a phonetic piece V prescribes a spectrum of a voice of each of frames of the phonetic piece V (the phoneme section $S_1$ and the phoneme section $S_2$) which are divided on a time axis. As will be described below, contents of unit data $U_A$ corresponding to a phoneme (a vowel or a voiced consonant) of a voiced sound and contents of unit data $U_A$ corresponding to an unvoiced sound (an unvoiced consonant) are different from each other.

As shown in FIG. 2, a piece of unit data $U_A$ corresponding to a phoneme of a voiced sound includes envelope data R and spectrum data Q. The envelope data R includes a shape parameter R, a pitch pF, and sound volume (energy) E. The shape parameter R is information indicating a spectrum (tone) of a voice. The shape parameter includes a plurality of variables indicating shape characteristics of an envelope line (tone) of a spectrum of a voice. A first embodiment of the envelope data R is, for example, an excitation plus resonance (EpR) parameter including an excitation waveform envelope r1, chest resonance r2, vocal tract resonance r3, and a difference spectrum r4. The EpR parameter is created through well-known spectral modeling synthesis (SMS) analysis. Meanwhile, the EpR parameter and the SMS analysis are disclosed, for example, in Japanese Patent No. 3711880 and Japanese Patent Application Publication No. 2007-226174.

The excitation waveform envelope (excitation curve) r1 is a variable approximate to an envelope line of a spectrum of vocal cord vibration. The chest resonance r2 designates a bandwidth, a central frequency, and an amplitude value of a predetermined number of resonances (band pass filters) approximate to chest resonance characteristics. The vocal tract resonance r3 designates a bandwidth, a central frequency, and an amplitude value of each of a plurality of resonances approximate to vocal tract resonance characteristics. The difference spectrum r4 means the difference (error) between a spectrum approximate to the excitation waveform envelope r1, the chest resonance r2 and the vocal tract resonance r3, and a spectrum of a voice.

As shown in FIG. 2, a piece of unit data $U_A$ corresponding to a phoneme of an unvoiced sound includes spectrum data Q. The unit data $U_A$ of the unvoiced sound do not include envelope data R. The spectrum data Q included in the unit data $U_A$ of both the voiced sound and unvoiced sound are data indicating a spectrum of a voice. Specifically, the spectrum data Q include a series of intensities (power and an amplitude value) of each of a plurality of frequencies on a frequency axis.

Figure 4:
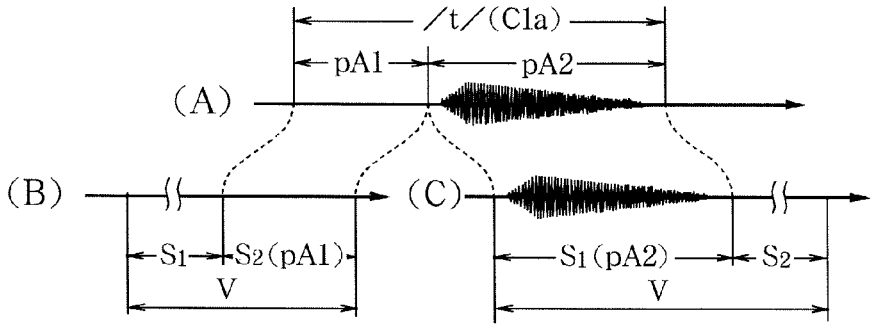
FIG. 4 is a typical view showing a relationship between a time domain waveform of a plosive sound or an affricate sound and each phoneme section of a phonetic piece.
Figure 5:
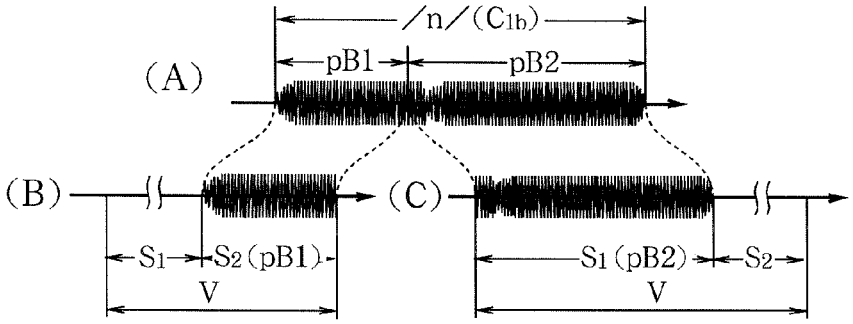
FIG. 5 is a typical view showing a relationship between a time domain waveform of a liquid sound or a nasal sound and each phoneme section of a phonetic piece.
Figure 6:
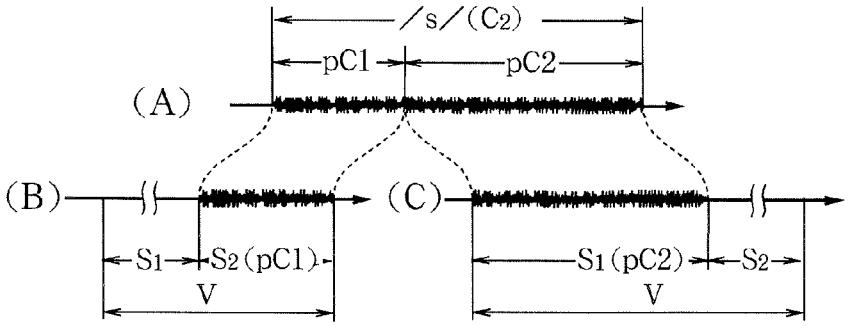
FIG. 6 is a typical view showing a relationship between a time domain waveform of a fricative sound or a semivowel sound and each phoneme section of a phonetic piece.

As shown in FIG. 3, a phoneme of a consonant belonging to each phoneme type is classified into a first type C1 (C1*a* and C1*b*) and a second type C2 based on an articulation method. A phoneme of the first type C1 is pronounced in a state in which a vocal tract is temporarily deformed from a predetermined preparation state. The first type C1 is divided into a type C1*a* and a type C1*b*. A phoneme of the type C1*a* is a phoneme in which air is completely stopped in both the oral cavity and the nasal cavity in a preparation state before pronunciation. Specifically, plosive sounds /t/, /k/ and /p/, and an affricate /ts/ belong to the type C1*a*. A phoneme of the type C1*b* is a phoneme in which ventilation is restricted in a preparation state but pronunciation is maintained even in a preparation state by ventilation via a portion of the oral cavity or the nasal cavity. Specifically, nasal sounds /m/ and /n/ and a liquid sound /r/ belong to the type C1*b*. On the other hand, a phoneme of the second type C2 is a phoneme in which normal pronunciation can be continued. Specifically, fricative sounds /s/ and /f/ and semivowels /w/ and /y/ belong to the second type C2.

time domain waveforms of phonemes of the respective types C1*a*, C1*b* and C2 are illustrated in parts (A) of FIGS. 4 to 6. As shown in a part (A) of FIG. 4, a phoneme (for example, a plosive sound /t/) of the type C1*a* is divided into a preparation process pA1 and a pronunciation process pA2 on a time axis. The preparation process pA1 is a process of closing a vocal tract for pronunciation of a phoneme. Since the vocal tract is closed to stop ventilation, the preparation process pA1 has an almost silence state. On the other hand, the pronunciation process pA2 is a process of temporarily and rapidly deforming the vocal tract from the preparation process pA1 to release an air current so that a phoneme is actually pronounced. Specifically, air compressed in the upstream side of the vocal tract at the preparation process pA1 is released at once by moving an upper jaw, for example, at the tip of tongue at the pronunciation process pA2.

In a case in which a phoneme section S2 at the rear of a phonetic piece V corresponds to a phoneme of the type C1*a*, as shown in a part (B) of FIG. 4, the phoneme section S2 includes the preparation process pA1 of the phoneme. Also, as shown in a part (C) of FIG. 4, a phoneme section S1 at the front of the phonetic piece V corresponding to a phoneme of the type C1*a* includes the pronunciation process pA2 of the phoneme. That is, the phoneme section S2 of the part (B) of FIG. 4 is followed by the phoneme section S1 of the part (C) of FIG. 4 to synthesize a phoneme (for example, a plosive sound /t/) of the type C1*a*.

As shown in a part (A) of FIG. 5, a phoneme (for example, a nasal sound /n/) of the type C1*b* is divided into a preparation process pB1 and a pronunciation process pB2 on a time axis. The preparation process pB1 is a process of restricting ventilation of a vocal tract for pronunciation of a phoneme. The preparation process pB1 of the phoneme of the type C1*b* is different from the preparation process pA1 of the phoneme of the type C1*a*, in which ventilation is stopped, and therefore, an almost silent state is maintained, in that ventilation from the vocal chink is restricted but pronunciation is maintained through ventilation via a portion of the oral cavity or the nasal cavity. On the other hand, the pronunciation process pB2 is a process of temporarily and rapidly deforming the vocal tract from the preparation process pB1 to actually pronounce a phoneme in the same manner as the pronunciation process pA2. As shown in a part (B) of FIG. 5, the preparation process pB1 of the phoneme of the type C1*b* is included in a phoneme section S2 at the rear of a phonetic piece V, and the preparation process pB2 of the phoneme of the type C1*b* is included in a phoneme section S1 at the front of the phonetic piece V. The phoneme section S2 of the part (B) of FIG. 5 is followed by the phoneme section S1 of the part (C) of FIG. 5 to synthesize a phoneme (for example, a nasal sound /n/) of the type C1*b*.

As shown in a part (A) of FIG. 6, a phoneme (for example, a fricative sound /s/) of the second type C2 is divided into a front part pC1 and a rear part pC2 on a time axis. The front part pC1 is a process in which pronunciation of the phoneme is commenced to transition to a stably continuous state, and the rear part pC2 is a process in which pronunciation of the phoneme is ended from the normally continuous state. As shown in a part (B) of FIG. 6, the front part pC1 is included in a phoneme section S2 at the rear of a phonetic piece V, and as shown in a part (A) of FIG. 6 the rear part pC2 is included in a phoneme section S1 at the front of the phonetic piece V. In order to satisfy the above conditions, each phonetic piece V is extracted from a voice of a specific speaker, each phoneme section S is delimited, and phonetic piece data $D_A$ for each phonetic piece V are made.

As shown in FIG. 1, the synthesis information (score data) $G_B$ to designate a synthesized sound in a time series is stored in the storage unit 14. The synthesis information $G_B$ designates a pronunciation letter $X_1$, a pronunciation period $X_2$ and a pitch $X_3$ of a synthesized sound in a time series, for example, for every note. The pronunciation letter $X_1$ is an alphabet series of song words, for example, in case of synthesizing a singing voice, and the pronunciation period $X_2$ is designated, for example, as pronunciation start time and duration. The synthesis information $G_B$ is created, for example, according to user manipulation through various kinds of input equipment, and is then stored in the storage unit 14. Meanwhile, synthesis information $G_B$ received from another communication terminal via a communication network or synthesis information $G_B$ transmitted from a variable recording medium may be used to create the voice signal $V_{OUT}$.

Figure 7:
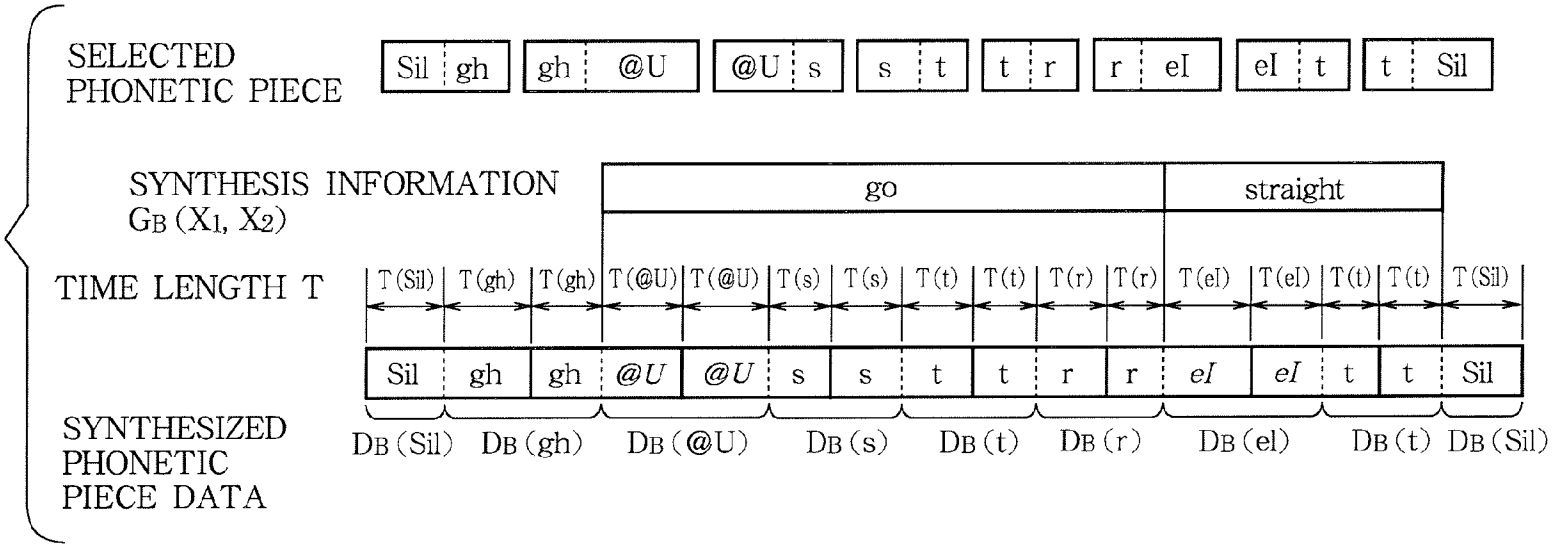
FIG. 7 is a diagram illustrating selection of a phonetic piece and setting of synthesis time length.

The phonetic piece selection part 22 of FIG. 1 sequentially selects phonetic piece data V corresponding to each pronunciation letter $X_1$ designated by the synthesis information $G_B$ in a time series from the phonetic piece group $G_A$. For example, in a case in which a phrase 'go straight' is designated as the pronunciation letter $X_1$ of the synthesis information $G_B$, as shown in FIG. 7, the phonetic piece selection part 22 selects eight phonetic pieces V, such as [Sil-gh], [gh-@U], [@U-s], [s-t], [t-r], [r-eI], [eI-t] and [t-Sil]. Meanwhile, a symbol of each phoneme is based on Speech Assessment Methods Phonetic Alphabet (SAMPA). X-SAMPA (eXtended-SAMPA) also adopts the same symbol system. Meanwhile, the symbol 'Sil' of FIG. 7 means silence.

The phoneme length setting part 24 of FIG. 1 variably sets a time length T when applied to synthesis of a voice signal $V_{OUT}$ (hereinafter, referred to as a 'synthesis time length') with respect to each phoneme section S (S1 and S2) of the phonetic piece V sequentially selected by the phonetic piece selection part 22. The synthesis time length T of each phoneme section S is selected according to the pronunciation period $X_2$ designated by the synthesis information $G_B$ in a time series. Specifically, as shown in FIG. 7, the phoneme length setting part 24 sets a synthesis time length T (T(Sil), T(gh), T(@U), . . . ) of each phoneme section S so that the start point of a phoneme (an italic phoneme of FIG. 7) of a principal vowel constituting the pronunciation letter $X_1$ accords with the start point of a pronunciation period $X_2$ of the pronunciation letter $X_1$, and front and rear phoneme sections S are arranged on a time axis without a gap.

Figure 8:
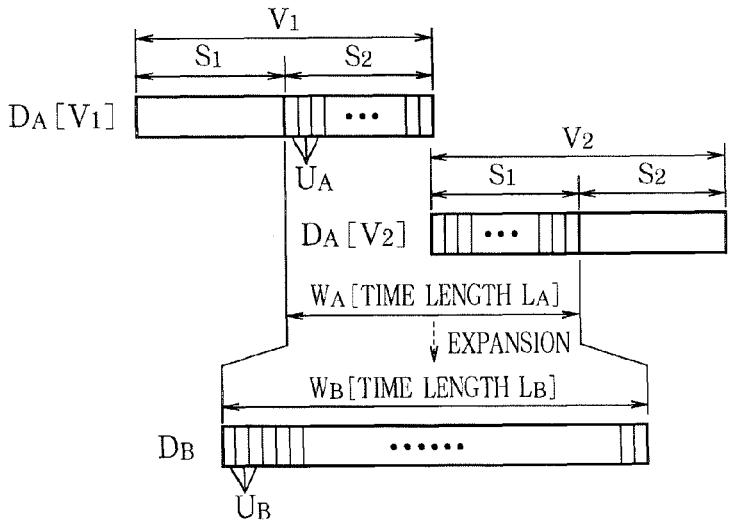
FIG. 8 is a view illustrating expansion of a target section.

The phonetic piece adjustment part 26 of FIG. 1 expands and contracts each phoneme section S of the phonetic piece V selected by the phonetic piece selection part 22 based on the synthesis time length T set by the phoneme length setting part 24 with respect to the phoneme section S thereof. For example, in a case in which the phonetic piece selection part 22 selects a phonetic piece $V_1$ and a phonetic piece $V_2$, as shown in FIG. 8, the phonetic piece adjustment part 26 expands and contracts a section (hereinafter, referred to as a 'target section') $W_A$ of a time length $L_A$ obtained by interconnecting a rear phoneme section $S_2$ which is rear phoneme of the phonetic piece $V_1$ and a font phoneme section $S_1$ which is a front phoneme of the phonetic piece $V_2$ to a section (hereinafter, referred to as an 'adjustment section') $W_B$ covering a target time length $L_B$ to create synthesized phonetic piece data $D_B$ indicating a voice of the adjustment section $W_B$ after expansion and contraction. Meanwhile, a case of expanding the target section $W_A$ ($L_A<L_B$) is illustrated in FIG. 8. The time length $T_B$ of the adjustment section $W_B$ is the sum of the synthesis time length T of the phoneme section $S_2$ of the phonetic piece $V_1$ and the synthesis time length T of the phoneme section $S_1$ of the phonetic piece $V_2$. As shown in FIG. 8, the synthesized phonetic piece data $D_B$ created by the phonetic piece adjustment part 26 is a time series of a number of (N) unit data $U_B$ corresponding to the time length $L_B$ of the adjustment section $W_B$. As shown in FIGS. 7 and 8, a piece of synthesized phonetic piece data $D_B$ is created for every pair of a rear phoneme section $S_2$ of the first phonetic piece $V_1$ and a front phoneme section $S_1$ of the second phonetic piece $V_2$ immediately thereafter (that is, for every phoneme).

The voice synthesis part 28 of FIG. 1 creates a voice signal $V_{OUT}$ using the synthesized phonetic piece data $D_B$ created by the phonetic piece adjustment part 26 for each phoneme. Specifically, the voice synthesis part 28 converts spectra indicated by the respective unit data $U_B$ constituting the respective synthesized phonetic piece data $D_B$ into a time domain waveform, interconnects the converted spectra of the frames, and adjusts the height of a sound based on the pitch $X_3$ of the synthesis information $G_B$ to create the voice signal V.

Figure 9:
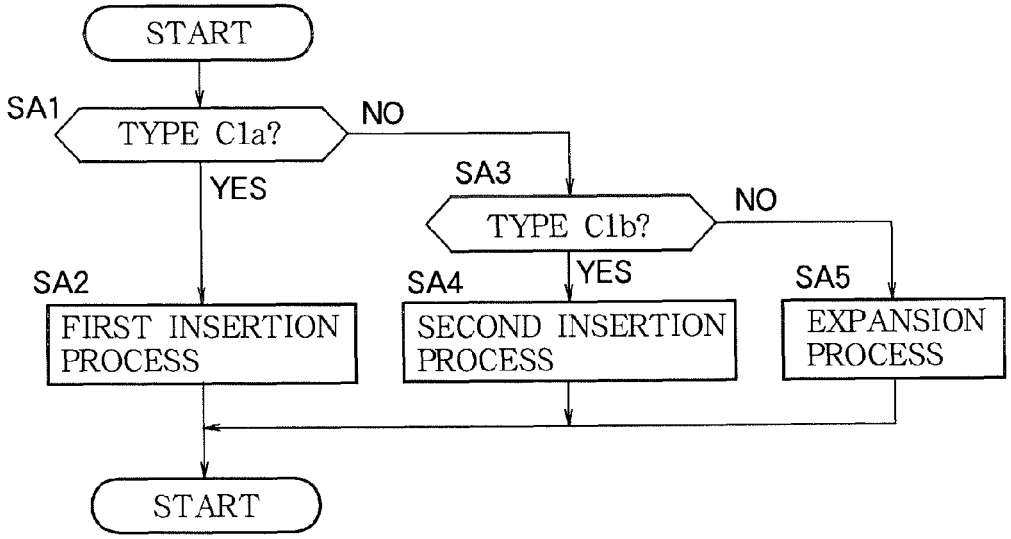
FIG. 9 is a flow chart showing an operation of expanding a phoneme of a consonant performed by a phonetic piece adjustment part.

FIG. 9 is a flow chart showing a process of the phonetic piece adjustment part 26 expanding a phoneme of a consonant to create synthesized phonetic piece data $D_B$. The process of FIG. 9 is commenced whenever selection of a phonetic piece V by the phonetic piece selection part 22 and setting of a synthesis time length T by the phoneme length setting part 24 are carried out with respect to a phoneme (hereinafter, referred to as a 'target phoneme') of a consonant. As shown in FIG. 8, it is assumed that the target section $W_A$ of the time length $L_A$ constituted by the phoneme section S2 corresponding to the target phoneme of the phonetic piece $V_1$ and the phoneme section $S_1$ corresponding to the target phoneme of the phonetic piece $V_2$ is expanded to the time length $L_B$ of the adjustment section $W_B$ to create synthesized phonetic piece data $D_B$ (a time series of N unit data $U_B$, corresponding to the respective frames of the adjustment section $W_B$).

Upon commencing the process of FIG. 9, the phonetic piece adjustment part 26 determines whether or not the target phoneme belongs to the type C1*a* ($S_{A1}$). Specifically, the phonetic piece adjustment part 26 carries out determination at step $S_{A1}$ based on whether or not the phoneme type indicated by the classification information $D_C$ of the phonetic piece data $D_A$ of the phonetic piece $V_1$ with respect to the phoneme section $S_2$ of the target phoneme corresponds to a predetermined classification (a plosive sound or an affricate) belonging to the type C1*a*. In a case in which the target phoneme belongs to the type C1*a* ($S_{A1}$: YES), the phonetic piece adjustment part 26 carries out a first insertion process to create synthesized phonetic piece data $D_B$ of the adjustment section $W_B$ ($S_{A2}$).

Figure 10:
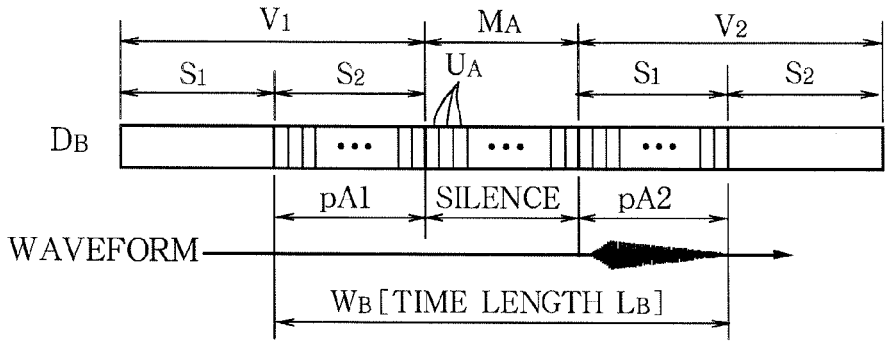
FIG. 10 is a view illustrating a first insertion process.

As shown in FIG. 10, the first insertion process is a process of inserting an intermediate section $M_A$ between the phoneme section $S_2$ at the rear of the phonetic piece $V_1$ and the phoneme section $S_1$ at the front of the phonetic piece $V_2$ immediately thereafter to expand the target section $W_A$ to the adjustment section $W_B$ of the time length $L_B$. As described with reference to FIG. 4, the preparation process pA1 having the almost silent state is included in the phoneme section $S_2$ corresponding to the phoneme of the type C1*a*. For this reason, in the first insertion process of step $S_{A2}$, the phonetic piece adjustment part 26 inserts a time series of a plurality of unit data UA indicating silence as the intermediate section $M_A$. That is, as shown in FIG. 10, the synthesized phonetic piece data $D_B$ created through the first insertion process at step $S_{A2}$, are constituted by a time series of N unit data $U_B$ in which the respective unit data $U_A$ of the phoneme section $S_2$ of the phonetic piece $V_1$, the respective unit data $U_A$ of the intermediate section (silence section) $M_A$, and the respective unit data $U_A$ of the phoneme section $S_1$ of the phonetic piece $V_2$ are arranged in order.

In a case in which the target phoneme does not belong to the type C1*a* ($S_{A1}$: NO), the phonetic piece adjustment part 26 determines whether or not the target phoneme belongs to the type C1*b* (a liquid sound or nasal sounds) ($S_{A3}$). A determination method of step $S_{A3}$ is identical to that of step $S_{A1}$. In a case in which the target phoneme belongs to the type C1*b* ($S_{A3}$: YES), the phonetic piece adjustment part 26 carries out a second insertion process to create synthesized phonetic piece data $D_B$ of the adjustment section $W_B$ ($S_{A4}$).

Figure 11:
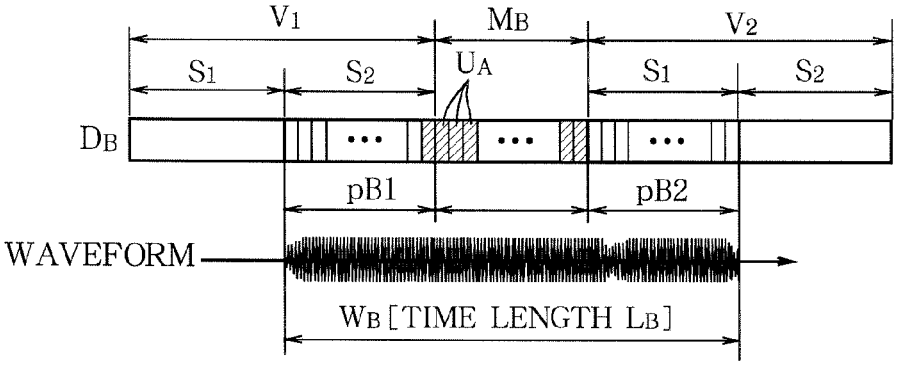
FIG. 11 is a view illustrating a second insertion process.

As shown in FIG. 11, the second insertion process is a process of inserting an intermediate section $M_B$ between the phoneme section $S_2$ at the rear of the phonetic piece $V_1$ and the phoneme section $S_1$ at the front of the phonetic piece $V_2$ immediately thereafter to expand the target section $W_A$ to the adjustment section $W_B$ of the time length $L_B$. As described with reference to FIG. 5, the preparation process pB1, in which pronunciation is maintained through a portion of the oral cavity or the nasal cavity, is included in the phoneme section $S_2$ corresponding to the phoneme of the type C1*b*. For this reason, in the second insertion process of step $S_{A4}$, the phonetic piece adjustment part 26 inserts a time series of a plurality of unit data $U_A$, in which unit data UA (the shaded portions of FIG. 11) of the frame at the endmost part of the phonetic piece $V_1$ are repeatedly arranged, as the intermediate section $M_B$. Consequently, the synthesized phonetic piece data $D_B$ created through the second insertion process at step $S_{A4}$, are constituted by a time series of N unit data $U_B$ in which the respective unit data $U_A$ of the phoneme section $S_2$ of the phonetic piece $V_1$, a plurality of unit data $U_A$ at the endmost part of the phoneme section $S_2$, and the respective unit data $U_A$ of the phoneme section $S_1$ of the phonetic piece $V_2$ are arranged in order.

In a case in which the target phoneme belongs to the first type C1 (C1*a* and C1*b*) as described above, the phonetic piece adjustment part 26 inserts the intermediate section M ($M_A$ and $M_B$) between the phoneme section $S_2$ at the rear of the phonetic piece $V_1$ and the phoneme section $S_1$ at the front of the phonetic piece $V_2$ to create synthesized phonetic piece data $D_B$ of the adjustment section $W_B$. Meanwhile, the frame at the endmost part of the preparation process pA1 (the phoneme section $S_2$ of the phonetic piece $V_1$) of the phoneme belonging to the type C1*a* is almost silence, and therefore, in a case in which the target phoneme belongs to the type C1*a*, it is also possible to carry out a second insertion process of inserting a time series of unit data UA of the frame at the endmost part of the phoneme section $S_2$ as the intermediate section $M_B$ in the same manner as step $S_{A4}$.

In a case in which the target phoneme belongs to the second type C2 ($S_{A1}$: NO and $S_{A3}$: NO), the phonetic piece adjustment part 26 carries out an expansion process of expanding the target section $W_A$, so that an expansion rate of the central part in the time axis direction of the target section $W_A$ of the target phoneme is higher than that of the front part and the rear part of the target section $W_A$ (the central part of the target section $W_A$ is much more expanded than the front part and the rear part of the target section $W_A$), to create synthesized phonetic piece data $D_B$ of the adjustment section $W_B$ of the time length $L_B$ ($S_{A5}$).

Figure 12:
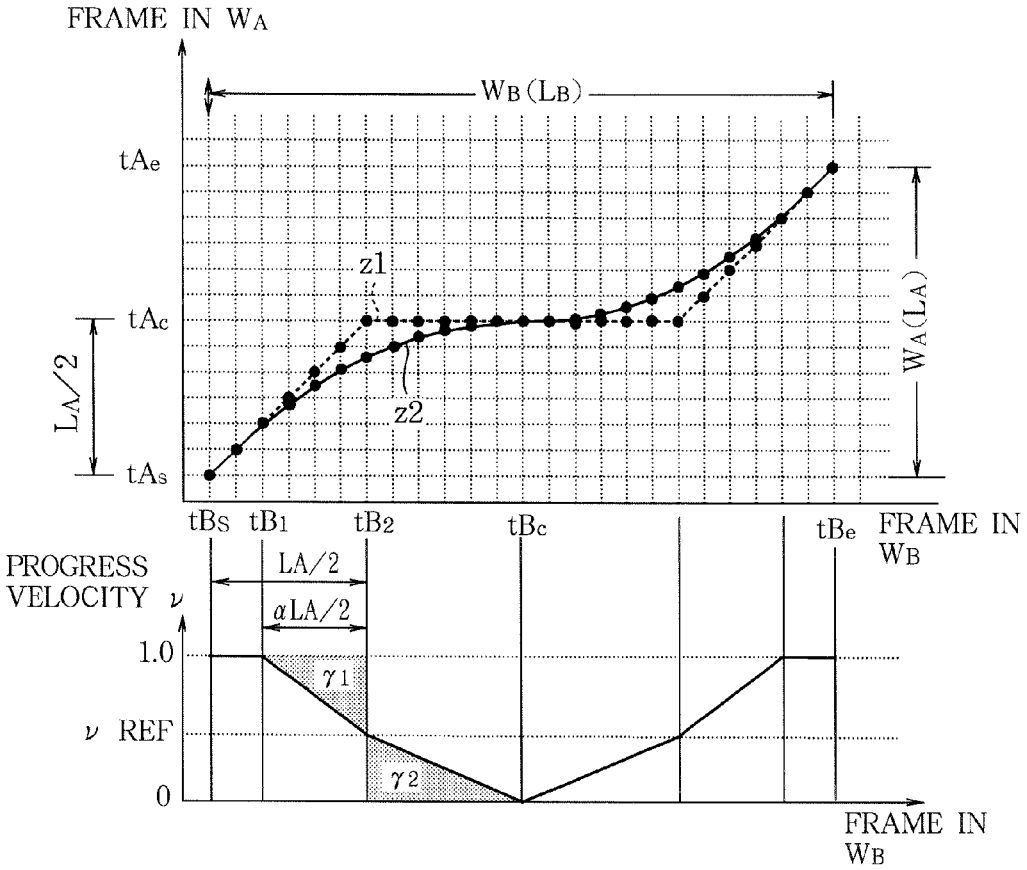
FIG. 12 is a graph illustrating an expansion process.

FIG. 12 is a graph showing a time-based correspondence relationship between the adjustment section $W_B$ (horizontal axis) after expansion through the expansion process of step $S_{A5}$ and the target section $W_A$ (vertical axis) before expansion. Each time point in the target section $W_A$ corresponding to each frame in the adjustment section $W_B$ is indicated by a black spot. As shown in FIG. 12 as a trajectory z1 (a broken line) and a trajectory z2 (a solid line), each frame in the adjustment section $W_B$ corresponds to a time point in the target section $W_A$. Specifically, a frame of the start point tBs of the adjustment section $W_B$ corresponds to a frame of the start point tAs of the target section $W_A$, and a frame of the end point tBe of the adjustment section $W_B$ corresponds to a frame of the end point tAe of the target section $W_A$. Also, a frame of the central point tBc of the adjustment section $W_B$ corresponds to a frame of the central point tAc of the target section $W_A$. Unit data $U_A$ corresponding to each frame in the adjustment section $W_B$ are created based on unit data UA at the time point corresponding to the frame in the target section $W_A$.

Hereinafter, the time length (distance on the time axis) in the target section $W_A$ corresponding to a predetermined unit time in the adjustment section $W_B$ will be expressed as progress velocity ν. That is, the progress velocity ν is velocity at which each frame in the target section $W_A$ corresponding to each frame in the adjustment section $W_B$ is changed according to passage of time in the adjustment section $W_B$. Consequently, in a section in which the progress velocity ν is 1 (for example, the front part and the rear part of the adjustment section $W_B$), each frame in the target section $W_A$ and each frame in the adjustment section $W_B$ correspond to each other one to one, and, in a section in which the progress velocity ν is 0 (for example, the central part in the adjustment section $W_B$), a plurality of frames in the adjustment section $W_B$ correspond to a single frame in the target section $W_A$ (that is, the frame in the target section $W_A$ is not changed according to passage of time in the adjustment section $W_B$).

A graph showing time-based change of the progress velocity ν in the adjustment section $W_B$ is also shown in FIG. 12. As shown in FIG. 12, the phonetic piece adjustment part 26 makes each frame in the adjustment section $W_B$ correspond to each frame in the target section $W_A$ so that the progress velocity ν from the start point tBs to the central point tBc of the adjustment section $W_B$ is decreased from 1 to 0, and the progress velocity ν from the central point tBc to the end point tBe of the adjustment section $W_B$ is increased from 0 to 1.

Specifically, the progress velocity ν is maintained at 1 from the start point tBs to a specific time point tB1 of the adjustment section $W_B$, is then decreased over time from the time point tB1, and reaches 0 at the central point tBc of the adjustment section $W_B$. After the central point tBc, the progress velocity ν is changed in a trajectory obtained by reversing the section from the start point tBs to the central point tBc with respect to the central point tBc in the time axis direction in line symmetry. As the result that the progress velocity ν is increased and decreased as above, the target section $W_A$ is expanded so that an expansion rate of the central part in the time axis direction of the target section $W_A$ of the target phoneme is higher than that of the front part and the rear part of the target section $W_A$ as previously described.

As shown in FIG. 12, a change rate (tilt) of the progress velocity ν is changed (lowered) at a specific time point tB2 between the time point tB1 and the central point tBc. The time point tB2 corresponds to a time point at which a half of the time length ($L_A/2$) of the target section $W_A$ from the start point tBs elapses. The time point tB1 is a time point which is short of the time point tB2 by time length $\alpha\cdot(L_A/2)$. The variable α is selected within a range of between 0 and 1. In order that the central point tBc of the adjustment section $W_B$ and the central point tAc of the target section $W_A$ correspond to each other, it is necessary for a triangle γ1 and a triangle γ2 of FIG. 12 to have the same area, progress velocity νREF at the time point tB1 is selected according to the variable α so as to satisfy the above conditions.

As can be understood from FIG. 12, as the variable α approaches 1, the time point tB1, at which the progress velocity ν in the adjustment section $W_B$, starts to be lowered, gets close to the start point tBs. That is, in a case in which the variable α is set to 1, the progress velocity ν is decreased from the start point tBs of the adjustment section $W_B$, and, in a case in which the variable α is set to 0 (tB1=tB2), the progress velocity ν is discontinuously changed from 1 to 0 at the time point tB2. That is, the variable α is a numerical value deciding wideness and narrowness of a section to be expanded of the target section $W_A$ (for example, the entirety of the target section $W_A$ is uniformly expanded as the variable α approaches 1). The trajectory z1 shown by the broken line in FIG. 12 denotes correspondence between the adjustment section $W_B$ and the target section $W_A$ in a case in which the variable $\alpha$ is set to 0, and the trajectory z2 shown by the solid line in FIG. 12 denotes correspondence between the adjustment section $W_B$ and the target section $W_A$ in a case in which the variable $\alpha$ is set to a numerical value between 0 and 1 (for example, 0.75).

Figure 13:
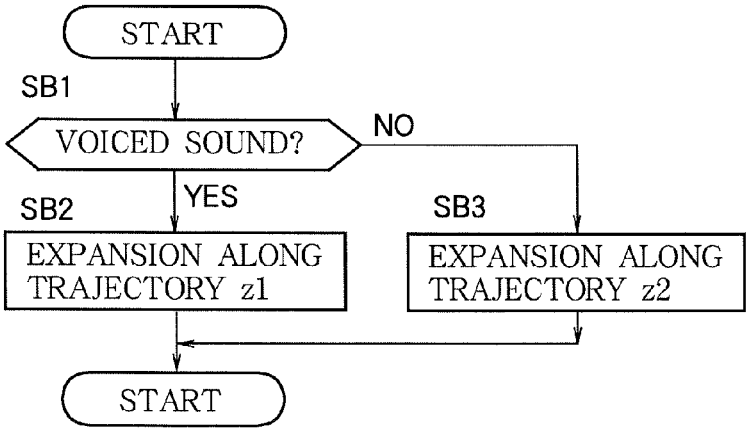
FIG. 13 is a flow chart showing contents of the expansion process.

FIG. 13 is a flow chart showing the expansion process carried out at step $S_{A5}$ of FIG. 9. Upon commencing the expansion process, the phonetic piece adjustment part 26 determines whether or not the target phoneme is a voiced sound (in case of considering that the process of FIG. 9 is carried out with respect to a consonant, whether or not the target phoneme is a voiced consonant) ($S_{B1}$). In a case in which the target phoneme is a voiced sound ($S_{B1}$: YES), the phonetic piece adjustment part 26 expands the target section $W_A$, so that the adjustment section $W_B$ and the target section $W_A$ satisfy a relationship of the trajectory z1, to create synthesized phonetic piece data $D_B$ of the adjustment section $W_B$ ($S_{B2}$). Hereinafter, a concrete example of step $S_{B2}$ will be described in detail.

Figure 14:
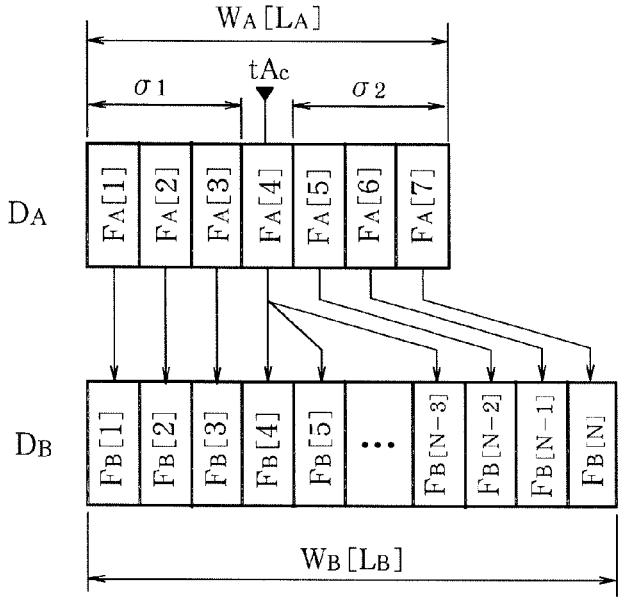
FIG. 14 is a view illustrating an expansion process carried out with respect to a phoneme of a voiced sound.

First, as shown in FIG. 14, it is assumed that the target section $W_A$ includes an odd number (2K+1) of frames $F_{A[1]}$ to $F_{A[2K+1]}$. A case (K=3) in which the target section $W_A$ includes 7 frames $F_{A[1]}$ to $F_{A[7]}$ is illustrated in FIG. 14. The target section $W_A$ is divided into a frame $F_{A[K+1]}$ corresponding to a time point tAc of the central point thereof, a front part $\sigma$1 including K frames $F_{A[1]}$ to $F_{A[K]}$ before the time point tAc, and a rear part $\sigma$2 including K frames $F_{A[K+2]}$ to $F_{A[2K+1]}$ after the time point tAc. The phonetic piece adjustment part 26 creates a time series of N unit data $U_B$ (frames $F_{B[1]}$ to $F_{B[N]}$), in which a time series of unit data $U_A$ of K frames $F_{A[1]}$ to $F_{A[K]}$ of the front part $\rho$1 of (2K+1) unit data $U_A$ of the target phonetic piece, a time series of unit data $U_A$ of the frame $F_{A[K+1]}$ corresponding to the central point tAc, which is repeated a plurality of times, and a time series of unit data $U_A$ of K frames $F_{A[K+2]}$ to $F_{A[2K+1]}$ of the rear part $\sigma$2 are arranged in order, as synthesized phonetic piece data $D_B$.

Figure 15:
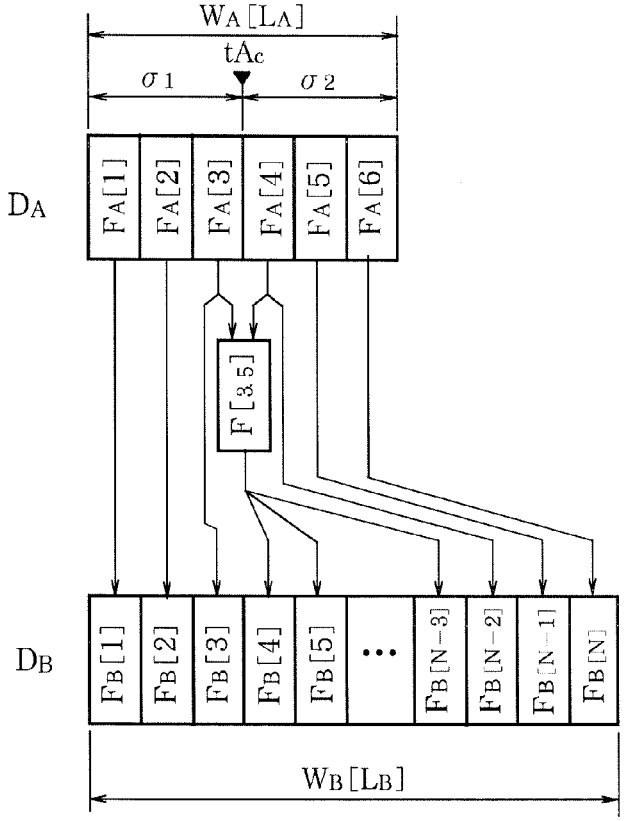
FIG. 15 is a view illustrating an expansion process carried out with respect to a phoneme of a voiced sound.

Next, as shown in FIG. 15, it is assumed that the target section $W_A$ includes an even number (2K) of frames $F_{A[1]}$ to $F_{A[2K]}$. A case (K=3) in which the target section $W_A$ includes 6 frames $F_{A[1]}$ to $F_{A[6]}$ is illustrated in FIG. 15. The target section $W_A$ including an even number of frames $F_A$ is divided into a front part of including K frames $F_{A[1]}$ to $F_{A[K]}$ and a rear part $\sigma$2 including K frames $F_{A[K-1]}$ to $F_{A[2K]}$. A frame $F_{A[K+0.5]}$ corresponding to the central point tAc of the target section $W_A$ does not exist. For this reason, the phonetic piece adjustment part 26 creates unit data $U_A$ corresponding to the frame $F_{A[K+0.5]}$ of the central point tAc of the target section $W_A$ using unit data $U_A$, of a frame $F_{A[K]}$ just before the central point tAc and unit data $U_A$ of a frame $F_{A[K+1]}$ just after the central point tAc.

As previously described, unit data $U_A$ of a voiced sound include envelope data R and spectrum data Q. The envelope data R can be interpolated between the frames for respective variables r1 to r4. On the other hand, a spectrum indicated by the spectrum data Q is changed moment by moment for every frame with the result that, in a case in which the spectrum data Q are interpolated between the frames, a spectrum having characteristics different from those of the spectrum before interpolation may be calculated. That is, it is difficult to properly interpolate the spectrum data Q.

In consideration of the above problems, the phonetic piece adjustment part 26 of the first embodiment calculates the envelope data R of the unit data $U_A$ of the frame $F_{A[K+0.5]}$ of the central point tAc of the target section $W_A$ by interpolating the respective variables r1 to r4 of the envelope data R between the frame $F_{A[K]}$ just before the central point tAc and the frame $F_{A[K+1]}$ just after the central point tAc. For example, in an illustration of FIG. 15, envelope data R of unit data $U_A$ of a frame $F_{A[3.5]}$ are created through interpolation of envelope data R of a frame $F_{A[3]}$ and envelope data R of a frame $F_{A[4]}$. For example, various kinds of interpolation processes, such as linear interpolation, are arbitrarily adopted to interpolate the envelope data R.

Also, the phonetic piece adjustment part 26 appropriates the spectrum data Q of the unit data $U_A$ of the frame $F_{A[K+1]}$ just after the central point tAc of the target section $W_A$ (or the spectrum data Q of the frame $F_{A[K]}$ just before the central point tAc of the target section $W_A$) as the spectrum data Q of the unit data $U_A$ of the frame $F_{A[K+0.5]}$ corresponding to the central point tAc of the target section $W_A$. For example, in an illustration of FIG. 15, spectrum data Q of unit data $U_A$ of a frame $F_{A[4]}$ (or the frame $F_{A[3]}$) are selected as spectrum data Q of unit data $U_A$ of a frame $F_{A[3.5]}$. As can be understood from the above description, the synthesized phonetic piece data $D_B$ created by the phonetic piece adjustment part 26 include N unit data $U_B$ (frames $F_{B[1]}$ to $F_{B[N]}$), in which a time series of unit data $U_A$ of K frames $F_{A[1]}$ to $F_{A[K]}$ of the front part $\sigma$1 of 2K unit data $U_A$ of the target phonetic piece, a time series of unit data $U_A$ of the frame $F_{A[K+0.5]}$ created through interpolation, which is repeated a plurality of times, and a time series of unit data $U_A$ of K frames $F_{A[K+1]}$ to $F_{A[2K]}$ of the rear part $\sigma$2 are arranged in order.

On the other hand, in a case in which the target phoneme is an unvoiced sound ($S_{B1}$: NO), the phonetic piece adjustment part 26 expands the target section $W_A$, so that the adjustment section $W_B$ and the target section $W_A$ satisfy a relationship of the trajectory z2, to create synthesized phonetic piece data $D_B$ of the adjustment section $W_B$ ($S_{B3}$). As previously described, the unit data $U_A$ of the unvoiced sound include the spectrum data Q but do not include the envelope data R. The phonetic piece adjustment part 26 selects unit data $U_A$ of a frame nearest the trajectory z2 with respect to the respective frames in the adjustment section $W_B$ of a plurality of frames constituting the target section $W_A$ as unit data $U_B$ of each of N frames of the adjustment section $W_B$ to create synthesized phonetic piece data $D_B$ including N unit data $U_B$.

Figure 16:
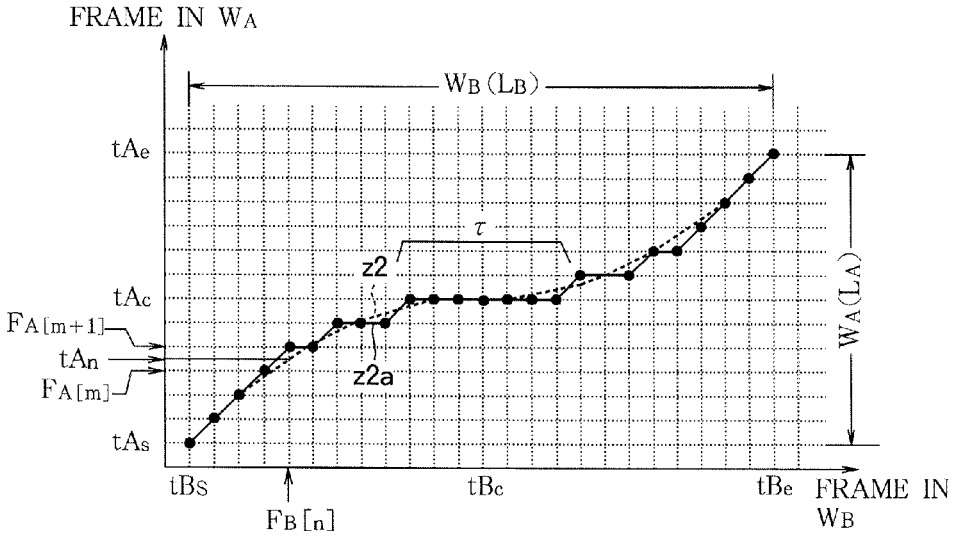
FIG. 16 is a graph illustrating an expansion process carried out with respect to a phoneme of an unvoiced sound.

A time point tAn in the target section $W_A$ corresponding to an arbitrary frame $F_{B[n]}$ of the adjustment section $W_B$ is shown in FIG. 16. In case in which a frame of the time point tAn satisfying a relationship of the trajectory z2 with respect to the frame $F_{B[n]}$ of the adjustment section $W_B$ does not exist in the target section $W_A$, the phonetic piece adjustment part 26 selects unit data $U_A$ of a frame $F_A$ nearest the time point tAn in the target section $W_A$ as unit data $U_B$ of the frame $F_{B[n]}$ of the adjustment section $W_B$ without interpolation of the unit data $U_A$. That is, unit data $U_A$ of the frame $F_A$ near the time point tAn, i.e. the frame $F_{A[m]}$ just before the time point tAn in the target section $W_A$ or the frame $F_{A[m+1]}$ just after the time point tAn in the target section $W_A$, is selected as unit data $U_B$ of the frame $F_{B[n]}$ of the synthesized phonetic piece data $D_B$. Consequently, a correspondence relationship between each frame in the adjustment section $W_B$ and each frame in the target section $W_A$ is a relationship of a trajectory z2*a* expressed by a broken line along the trajectory z2.

As described above, in the first embodiment, an expansion rate is changed in a target section $W_A$ corresponding to a phoneme of a consonant, and therefore, it is possible to synthesize an aurally natural voice as compared with Japanese Patent Application Publication No. H7-129193 in which the expansion rate is uniformly maintained within a range of a phonetic piece.

Also, in the first embodiment, an expansion method is changed according to types C1*a*, C1*b* and C2 of phonemes of consonants, and therefore, it is possible to expand each phoneme without excessively changing characteristics (particularly, a section important when a listener distinguishes a phoneme) of each phoneme.

For example, for a phoneme (a plosive sound or an affricate) of the type C1*a*, an intermediate section $M_A$ of silence is inserted between a preparation process pA1 and a pronunciation process pA2, and therefore, it is possible to expand a target section $W_A$ while little changing characteristics of the pronunciation process pA2, which are particularly important when a listener distinguishes a phoneme. In the same manner, for a phoneme (a liquid sound or a nasal sound) of the type C1*b*, an intermediate section $M_B$, in which the final frame of a preparation process pB1 is repeated, is inserted between a preparation process pB1 and a pronunciation process pB2, and therefore, it is possible to expand a target section $W_A$ while little changing characteristics of the pronunciation process pB2, which are particularly important when distinguishing a phoneme. For a phoneme (a fricative sound or a semivowel) of the second type C2, a target section $W_A$ is expanded so that an expansion rate of the central part of a target section $W_A$ of the target phoneme is higher than that of the front part and the rear part of the target section $W_A$, and therefore, it is possible to expand the target section $W_A$ without excessively changing characteristics of the front part or the rear part, which are particularly important when a listener distinguishes a phoneme.

Also, in the expansion process of a phoneme of the second type C2, for spectrum data Q, which are difficult to interpolate, spectrum data Q of unit data $U_A$ in phonetic piece data $D_A$ are applied to synthesized phonetic piece data $D_B$, and, for envelope data R, envelope data R calculated through interpolation of frames before and after the central point tAc in a target section $W_A$ are included in unit data $U_B$ of the synthesized phonetic piece data $D_B$. Consequently, it is possible to synthesize an aurally natural voice as compared with a construction in which envelope data R are not interpolated.

Meanwhile, for example, a method of calculating envelope data R of each frame in an adjustment section $W_B$ so that the envelope data R follow a trajectory z1 through interpolation and of selecting spectrum data Q so that the spectrum data Q follow a trajectory z2 from phonetic piece data D (hereinafter, referred to as a 'comparative example') may be assumed as a method of expanding a phoneme of a voiced consonant. In the method of the comparative example, however, characteristics of the envelope data R and the spectrum data Q are different from each other with the result that a synthesized sound may be aurally unnatural. In the first embodiment, each piece of unit data of the synthesized phonetic piece data $D_B$ is created so that both the envelope data R and the spectrum data Q follow the trajectory z2, and therefore, it is possible to synthesize an aurally natural voice as compared with the comparative example. However, it is not intended that the comparative example is excluded from the scope of the present invention.

B: Second Embodiment

Hereinafter, a second embodiment of the present invention will be described. Meanwhile, elements of embodiments which will be described below equal in operation or function to those of the first embodiment are denoted by the same reference numerals used in the above description, and a detailed description thereof will be properly omitted.

In the first embodiment, in a case in which the target phoneme is an unvoiced sound, unit data $U_A$ of a frame satisfying a relationship of the trajectory z2 with respect to each frame in the adjustment section $W_B$ of a plurality of frames constituting the target section $W_A$ are selected. In the construction of the first embodiment, unit data $U_A$ of a frame in the target section $W_A$ are repeatedly selected over a plurality of frames (repeated sections τ of FIG. 16) in the adjustment section $W_B$. However, a synthesized sound, created by synthesized phonetic piece data $D_B$ in which a piece of unit data $U_A$ is repeated, may be artificial and unnatural. The second embodiment is provided to reduce unnaturalness of a synthesized sound caused by repetition of a piece of unit data $U_A$.

Figure 17:
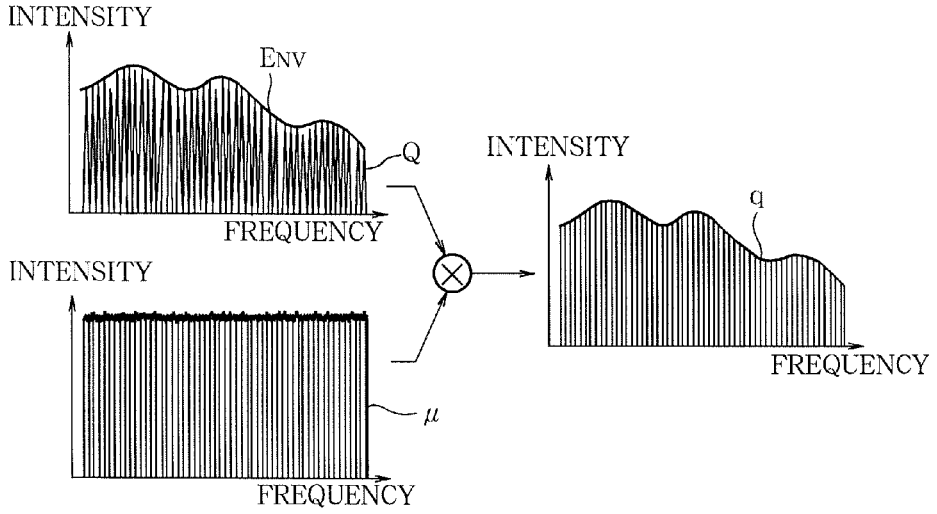
FIG. 17 is a view illustrating an expansion process carried out with respect to a phoneme of an unvoiced sound in a second embodiment.

FIG. 17 is a view illustrating the operation of a phonetic piece adjustment part 26 of the second embodiment. In a case in which the target phoneme is an unvoiced sound ($S_{B1}$: NO), the phonetic piece adjustment part 26 carries out the following process with respect to each $F_{B[n]}$ of N frames in the adjustment section $W_B$ to create N unit data $U_B$ corresponding to each frame.

First, the phonetic piece adjustment part 26 selects a frame $F_A$ nearest a time point tAn corresponding to a frame $F_{B[n]}$ in the adjustment section $W_B$ of a plurality of frames $F_A$ of the target section $W_A$ in the same manner as in the first embodiment, and, as shown in FIG. 17, calculates an envelope line $E_{NV}$ of a spectrum indicated by spectrum data Q of the unit data $U_A$ of the selected frame $F_A$. Subsequently, the phonetic piece adjustment part 26 calculates a spectrum q of a voice component in which a predetermined noise component μ randomly changing moment by moment on a time axis is adjusted based on the envelope line $E_{NV}$. A white noise, the intensity of which is almost uniformly maintained on a frequency axis over a wide area, is preferable as the noise component μ. The spectrum q is calculated, for example, by multiplying the spectrum of the noise component μ by envelope line $E_{NV}$. The phonetic piece adjustment part 26 creates unit data $U_A$ including spectrum data Q indicating the spectrum q as the unit data $U_B$ of the frame $F_{B[n]}$ in the adjustment section $W_B$.

As described above, in the second embodiment, in a case in which the target phoneme is an unvoiced sound, a frequency characteristic (envelope line $E_{NV}$) of the spectrum prescribed by the unit data $U_A$, of the target section $W_A$ is added to the noise component μ to create unit data $U_B$ of the synthesized phonetic piece data $D_B$. The intensity of the noise component μ at each frequency is randomly changed on the time axis every second, and therefore, characteristics of the synthesized sound is changed moment by moment over time (every frame) even in a case in which a piece of unit data $U_A$ in the target section $W_A$ is repeatedly selected over a plurality of frames in the adjustment section $W_B$. According to the second embodiment, therefore, it is possible to reduce unnaturalness of a synthesized sound caused by repetition of a piece of unit data $U_A$ as compared with the first embodiment in addition to the same effects as the first embodiment.

C: Third Embodiment

As also described in the second embodiment, for an unvoiced consonant, a piece of unit data $U_A$ of the target section $W_A$ can be repeated over a plurality of frames in the adjustment section $W_B$. On the other hand, each frame of the unvoiced consonant is basically an unvoiced sound but a frame of a voiced sound may be mixed. In a case in which a frame of a voiced sound is repeated in a synthesized sound of the phoneme of the unvoiced consonant, a periodic noise (a buzzing sound) which is very harsh to the ear may be pronounced. The third embodiment is provided to solve the above problems.

A phonetic piece adjustment part 26 of the third embodiment selects unit data $U_A$ of a frame corresponding to the central point tAc in a target section $W_A$ with respect to each frame in a repetition section $\tau$ continuously corresponding to a frame in the target section $W_A$ at a trajectory z2 of an adjustment section $W_B$. Subsequently, the phonetic piece adjustment part 26 calculates an envelope line $E_{NV}$ of a spectrum indicating spectrum data Q of a piece of unit data $U_A$ corresponding to the central point tAc of the target section $W_A$ and creates unit data $U_A$ including spectrum data Q of a spectrum in which a predetermined noise component $\mu$ is adjusted based on the envelope line $E_{NV}$ as unit data $U_B$ of each frame in the repetition section $\tau$ of the adjustment section $W_B$. That is, the envelope line $E_{NV}$ of the spectrum is common to a plurality of frames in the repetition section $\tau$. Meanwhile, the reason that the unit data $U_A$ corresponding to the central point tAc of the target section $W_A$ are selected as a calculation source of the envelope line $E_{NV}$ is that the unvoiced consonant can be stably and easily pronounced in the vicinity of the central point tAc of the target section $W_A$ (there is a strong possibility of an unvoiced sound).

The third embodiment also has the same effects as the first embodiment. Also, in the third embodiment, unit data $U_B$ of each frame in the repetition section $\tau$ are created using the envelope line $E_{NV}$ specified from a piece of unit data $U_A$ (particularly, unit data $U_A$ corresponding to the central point tAc) in the target section $W_A$, and therefore, a possibility of a frame of a voiced sound being repeated in a synthesized sound of a phoneme of an unvoiced consonant is reduced. Consequently, it is possible to restrain the occurrence of a periodic noise caused by repetition of the frame of the voiced sound.

D: Modifications

Each of the above embodiments may be modified in various ways. Hereinafter, concrete modifications will be illustrated. Two or more modifications arbitrarily selected from the following illustration may be appropriately combined.

(1) Although different methods of expanding the target section $W_A$ are used according to types C1*a*, C1*b* and C2 of phonemes of consonants in each of the above embodiments, it is also possible to expand the target section $W_A$ of a phoneme of each type using a common method. For example, it is also possible to expand a target section $W_A$ of a phoneme of a type C1*a* or a type C1*b* using an expansion process for expanding the target section $W_A$ (step $S_{A5}$ of FIG. 9) so that an expansion rate of the central part of the target section $W_A$ of the target phoneme is higher than that of the front part and the rear part of the target section $W_A$.

(2) The expansion process carried out at step $S_{A5}$ of FIG. 9 may be properly changed. For example, in a case in which the target phoneme is a voiced sound ($S_{B1}$: YES), it is also possible to expand the target section $W_A$ so that each frame of the adjustment section $W_B$ and each frame of the target section $W_A$ satisfy a relationship of the trajectory z2. The envelope shape parameter R of the unit data $U_B$ of each frame in the adjustment section $W_B$ is created through interpolation of the respective unit data $U_A$ in the target section $W_A$ between the frames, and the spectrum data Q of the unit data $U_A$ in the target section $W_A$ are selected as the spectrum data Q in the unit data $U_{13}$. Also, in a case in which the target phoneme is an unvoiced sound ($S_{B1}$: NO), it is also possible to expand the target section $W_A$ so that each frame of the adjustment section $W_B$ and each frame of the target section $W_A$ satisfy a relationship of the trajectory z1.

(3) In the second insertion process of the above described embodiments, the intermediate section $M_B$ is generated by repeatedly arranging unit data $U_A$ of the last frame of the phonetic piece $V_1$ (hatched portion of FIG. 11). It is expedient to freely change a position (frame) of the unit data $U_A$ on the time axis, the unit data $U_A$ being used for generation of the intermediate section $M_B$ in the second insertion process. For example, it is possible to generate the intermediate section $M_B$ by repeatedly arranging the unit data $U_A$ of the top frame of the phonetic piece $V_2$. As understood from the above examples, the second insertion process includes a process for inserting an intermediate section which is obtained by repeatedly arranging a specific frame or frames of the first phonetic piece $V_1$ or the second phonetic piece $V_2$.

(4) Although the envelope line $E_{NV}$ of the spectrum indicated by a piece of unit data $U_A$ selected from the target section $W_A$ is used to adjust the noise component $\mu$ in the second embodiment, it is also possible to adjust the noise component $\mu$ based on an envelope line $E_{NV}$ calculated through interpolation between the frames. For example, in a case in which a frame of the time point tAn satisfying a relationship of the trajectory z1 with respect to the frame $F_{B[n]}$ of the adjustment section $W_B$ does not exist in the target section $W_A$, as described with reference to FIG. 16, an envelope line $E_{NV[m]}$ of the spectrum indicated by the unit data $U_A$ of the frame $F_{A[m]}$ just before the time point tAn and an envelope line $E_{NV[m+1]}$ of the spectrum indicated by the unit data $U_A$ of the frame $F_{A[m+1]}$ just after the time point tAn are interpolated to create an envelope line $E_{NV}$ of the time point tAn, and the noise component $\mu$ is adjusted based on the envelope line after interpolation in the same manner as in the second embodiment.

(5) The form of the phonetic piece data $D_A$ or the synthesized phonetic piece data $D_B$ is optional. For example, although a time series of unit data U indicating a spectrum of each frame of the phonetic piece V is used as the phonetic piece data $D_A$ in each of the above embodiments, it is also possible to use a sample series of the phonetic piece V on the time axis as the phonetic piece data $D_A$.

(6) Although the storage unit 14 for storing the phonetic piece data group $G_A$ is mounted on the voice synthesis apparatus 100 in each of the above embodiments, there may be another configuration in which an external device (for example, a server device) independent from the voice synthesis apparatus 100 stores the phonetic piece data group $G_A$. In such a case, the voice synthesis apparatus 100 (the phoneme piece selection part 22) acquires the phonetic piece V (phonetic piece data $D_A$) from the external device through, for example, communication network so as to generate the voice signal $V_{OUT}$. In similar manner, it is possible to store the synthesis information $G_B$ in an external device independent from the voice synthesis apparatus 100. As understood from the above description, a device such as the aforementioned storage unit 14 for storing the phonetic piece data $D_A$ and the synthesis information $G_B$ is not an indispensable element of the voice synthesis apparatus 100.

What is claimed is:

1. An apparatus for synthesizing a voice signal using a plurality of phonetic piece data each indicating a phonetic piece which contains at least two phoneme sections corresponding to different phonemes, the apparatus comprising;

a voice synthesis processor configured to produce a voice signal for output of a sound wave from a sound output unit, wherein the voice synthesis processor includes a phonetic piece adjustment part that forms a target section from a first phonetic piece and a second phonetic piece so as to connect the first phonetic piece and the second phonetic piece to each other such that the target section is formed of a rear phoneme section of the first phonetic piece corresponding to a consonant phoneme and a front phoneme section of the second phonetic piece corresponding to the consonant phoneme, and that carries out an expansion process for expanding the target section by a target time length to form an adjustment section such that a central part of the target section is expanded at an expansion rate higher than that of a front part and a rear part of the target section, to thereby create synthesized phonetic piece data of the adjustment section having the target time length and corresponding to the consonant phoneme; and a voice synthesis part that creates a voice signal from the synthesized phonetic piece data created by the phonetic piece adjustment part, wherein the phonetic piece adjustment part carries out the expansion process in case that the consonant phoneme of the target section belongs to one type including fricative sound and semivowel sound, and carries out another expansion process in case that the consonant phoneme of the target section belongs to another type including plosive sound, affricate sound, nasal sound and liquid sound for inserting an intermediate section between the rear phoneme section of the first phonetic piece and the front phoneme section of the second phonetic piece in the target section.

2. The apparatus according to claim 1, wherein the phonetic piece adjustment part inserts a silence section as the intermediate section between the rear phoneme section of the first phonetic piece and the front phoneme section of the second phonetic piece in case that the consonant phoneme of the target section is plosive sound or affricate sound.

3. The apparatus according to claim 1, wherein the phonetic piece adjustment part inserts the intermediate section containing repetition of a frame selected from the rear phoneme section of the first phonetic piece or the front phoneme section of the second phonetic piece in case that the consonant phoneme of the target section is nasal sound or liquid sound.

4. The apparatus according to claim 3, wherein the phonetic piece adjustment part inserts the intermediate section containing repetition of the last frame of the rear phoneme section of the first phonetic piece.

5. The apparatus according to claim 3, wherein the phonetic piece adjustment part inserts the intermediate section containing repetition of the top frame of the front phoneme section of the second phonetic piece.

6. A method of synthesizing a voice signal using a processor configured to process a plurality of phonetic piece data each indicating a phonetic piece which contains at least two phoneme sections corresponding to different phonemes and outputting the voice signal in the form of a sound wave from a sound output unit, the method comprising the acts of;

forming using the processor a target section from a first phonetic piece and a second phonetic piece so as to connect the first phonetic piece and the second phonetic piece to each other such that the target section is formed of a rear phoneme section of the first phonetic piece corresponding to a consonant phoneme and a front phoneme section of the second phonetic piece corresponding to the consonant phoneme;

carrying out an expansion process for expanding the target section by a target time length to form an adjustment section such that a central part of the target section is expanded at an expansion rate higher than that of a front part and a rear part of the target section, to thereby create synthesized phonetic piece data of the adjustment section having the target time length and corresponding to the consonant phoneme;

creating a voice signal from the synthesized phonetic piece data created by the phonetic piece adjustment part, and forwarding the voice signal to a sound output unit for generating a sound wave corresponding to the voice signal, wherein the phonetic piece data comprises a plurality of unit data corresponding to a plurality of frames arranged on a time axis, wherein in case that the target section corresponds to an consonant phoneme of the target section belongs to one type including fricative sound and semivowel sound, and carries out another expansion process in case that the consonant phoneme of the target section belongs to another type including plosive sound, affricate sound, nasal sound and liquid sound for inserting an intermediate section between the rear phoneme section of the first phonetic piece and the front phoneme section of the second phonetic piece in the target section, and wherein velocity, at which each frame in the target section corresponding to each frame in the adjustment section is changed according to passage of time in the adjustment section, is decreased from a front part to a central point of the adjustment section and increased from the central point to a rear part of the adjustment section.

* * * * *